United States Patent [19]

Jakobs

[11] Patent Number: 5,005,775

[45] Date of Patent: Apr. 9, 1991

[54] TWO ROLLER MACHINE, PARTICULARLY A ROLL TYPE CRUSHER

[75] Inventor: Willy Jakobs, Cologne, Fed. Rep. of Germany

[73] Assignee: Kloeckner-Humboldte-Deutz Aktiengesellschaft, Fed. Rep. of Germany

[21] Appl. No.: 460,538

[22] Filed: Jan. 3, 1990

[30] Foreign Application Priority Data

Jan. 16, 1989 [DE] Fed. Rep. of Germany ..... 3901060

[51] Int. Cl.[5] ..... B02C 4/32

[52] U.S. Cl. ..... 241/232

[58] Field of Search ..... 72/240, 243, 199; 100/168, 169, 155 R; 241/268, 269, 230–234, 101.2

[56] References Cited

U.S. PATENT DOCUMENTS 3,970,256 7/1976 Ruegger et al. ..... 241/234 X 4,635,861 1/1987 Resch ..... 241/234 X

FOREIGN PATENT DOCUMENTS 3723605 1/1989 Fed. Rep. of Germany .

279328 11/1970 U.S.S.R. ..... 241/230

*Primary Examiner*—Mark Rosenbaum

*Attorney, Agent, or Firm*—Hill, Van Santen, Steadman & Simpson

[57] ABSTRACT

A two roller machine, and more particularly a roll type crusher, which comprises two oppositely driven rollers rotatably seated in a housing and having gearings connected to the drive journals of the rollers, the gearings being flexibly connected to one another by torque supports for absorbing the reaction moments and said torque supports being formed as two-armed lever plates and being rigidly joined to the gearing. A considerable simplification of the torque support is inventively achieved in that levers are rotationally arranged at the outer, opposite ends of the lever plates formed as torque supports, said levers being connected to one another by a toggle link.

13 Claims, 1 Drawing Sheet

TWO ROLLER MACHINE, PARTICULARLY A ROLL TYPE CRUSHER

BACKGROUND OF THE INVENTION

The invention relates to a two roller machine, and more particularly to a roll type crusher, comprised of two oppositely driven rollers which are rotatably seated in a housing and have gearing connected to the drive journals of the rollers. The gearings are flexibly connected to one another by torque supports for absorbing the reaction moments, and the torque supports are formed as two-armed levers which are rigidly joined to the gearings.

In a two roller machine such as shown, in German patent application P 37 23 605.9, the torque supports for absorbing the reaction moments have their upper and lower ends flexibly connected to one another by a hydraulic piston-cylinder unit that lies at a right angle relative to the roller shafts. The torque supports are formed as two-armed levers and are rigidly joined to the gearing. As a result thereof, the reaction moments of the two connected gearings are self-shorted by the two-armed lever plates and by the hydraulic cylinders, and both the roller bearings as well as the machine frame are kept free of additional shearing forces without impeding the excursion motion of the floating roller.

FEATURES OF THE INVENTION

In a two roller machine of the above mentioned type, the object of the invention is to improve, and in particular to simplify the connection of the torque supports formed as levers and which are required for absorbing the reaction moments in view of its structure and it function.

This object is achieved in that levers are rotationally arranged at the outer, opposite ends of the levers, and these levers are connected to one another by a toggle link. A mechanical connection of the torque supports to one another is achieved in that, compared to hydraulic piston-cylinder units as connecting elements, it is both considerably simpler in structural design and is also significantly more economical insofar as acquisition costs are concerned. Compared to hydraulic cylinders as connecting elements of the torque supports, they are also completely maintenance-free and operationally reliable.

Other objects, advantages and features will become more apparent with the teaching of the principles of the invention in connection with the disclosure of the embodiment thereof in the specification, claims and drawings, in which:

DESCRIPTION OF THE PREFERRED EMBODIMENTS

Figure 1:
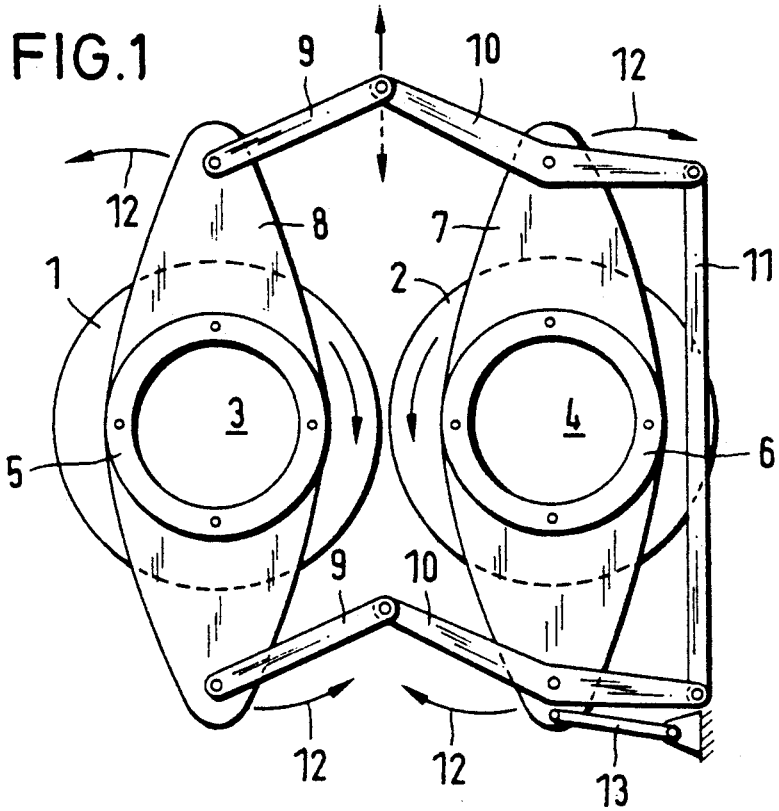
FIG. 1 is an end elevational view of a roll type crusher constructed and operating in accordance with the principles of the invention.

As shown in FIG. 1, a roll type crusher comprises two oppositely driven rollers 1 and 2 rotatably seated in a housing (not shown) having gearings 5 and 6 drivingly connected to the drive journals 3 and 4 of the rollers. These gearings 5 and 6 are flexibly connected to one another by lever plates 7 and 8 formed as torque supports for absorbing the reaction moments, and these lever plates are of a two-armed type and have a rigid connection to the gearings 5 and 6 so that they move radially with radial movement of the rolls.

According to the invention, levers 9 and 10 are pivotally connected at the outer, upper and lower ends of the lever plates 7 and 8 formed as torque supports. These levers 9 and 10 are connected to one another by a toggle link 11 arranged laterally at the outside which link is connected to the outer ends of the levers 10. A support arm 13 is pivotally connected at its outer end to the plate 7 and at its inner end to a stabilizing stationary frame. This locates and secures the assembly relative to the frame without binding the movement of the parts or limiting the coaction thereof. The levers 10 arranged at the lever plate 7 are advantageously formed as toggle levers. This inventive construction of the connecting levers to the lever plates 7 and 8 are formed as torque supports for absorbing the reaction moments, (arrowed lines 12). These movements are caused by the gearings 5 and 6. The structure is distinguished by its simple structural format and its relatively low manufacturing costs and is also distinguished by its being maintenance-free and functional.

During operation of the roll type crusher, every radial excursion motion of the floating roller 1 relative to the fixed roller 2 is enabled in a simple way without having the plates 7 and 8 change their position parallel to one another. As a result of the inventive construction of the levers connecting the plates 7 and 8, the machine frame of the roll type crusher is also kept free of any shearing forces. A compensating support 13 is provided at the machine frame only for absorbing differential torques between the gearings 5 and 6 that occur during the operation of the roll type crusher.

Figure 2:
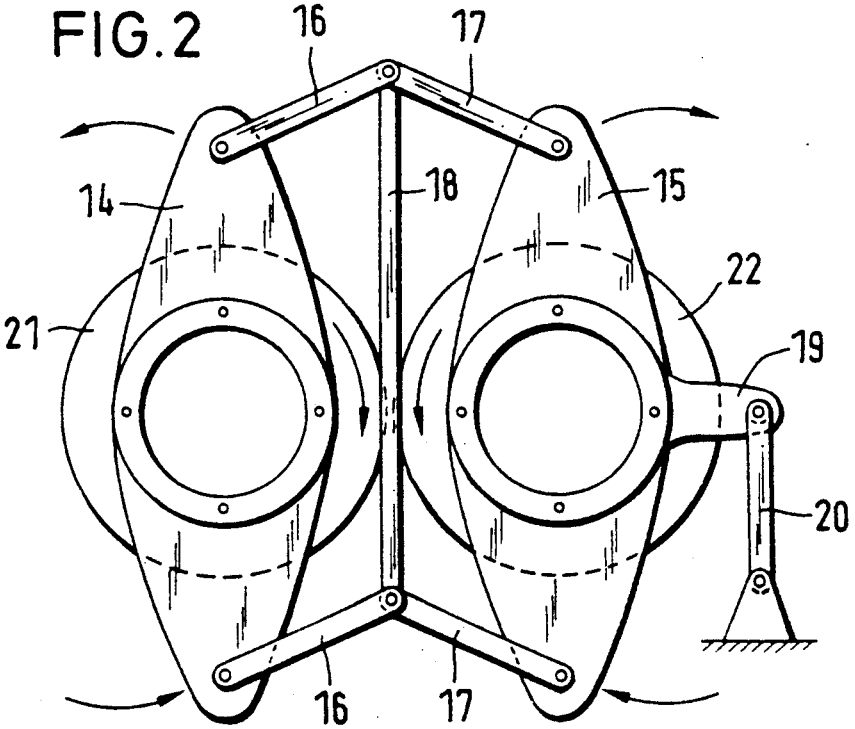
FIG. 2 is another view similar to FIG. 1 but showing a modified form of the invention.

In the two roller machine shown in FIG. 2, levers 16, 17 are pivotally connected at the outer, opposite ends of the torque supports formed as two-armed lever plates 14, 15. The levers are formed identical and are connected to one another by a link 18 located in the middle and parallel to the lever plates 14 and 15. The plate 15 which carries the levers 17 is provided with a bell crank continuation 19 that is joined to the machine housing in an articulated manner by a pivotal arm support 20. In the same manner as the support arm 13 shown in FIG. 1, the support arm 20 also serves as a compensating support that is loaded only by the differential torque between the two drives of the rollers 21 and 22 during operation of the roller machine. This torque support assembly shown in FIG. 2 with its levers 16, 17 and connecting rod 18 also represents another advantageous design that is extremely simple in structure for the absorption of the reaction moments during operation of the two roller machine, and which can be easily attached to already existing two roller machines.

In summary, the plates 7 and 8 always remain parallel despite movement of the rolls 1 and 2 relative to each other with the passage of material through the nip between the rolls. The lateral or radial thrust on the rolls is uniformly assimilated at the ends of the plates because the interconnecting levers 9 and 10 join to each other by virtue of the link 11 which joins the outer end of the levers 10. Each of the joints is pivotal in nature so that a non-binding operation occurs.

In the arrangement of FIG. 2, the coaction is quite similar to the arrangement of FIG. 1 wherein the plates 14 and 15 remain parallel with forces on the rolls 21 and 22. Forces are equally assimilated at the ends of the plates by the levers 16 and 17 which are pivotally joined to each other and to the plates and which are forced to have the same pivotal movement by the interconnecting link 18.

Thus, it will be seen that I have provided an improved crushing roller structure which is simplified in arrangement. While just one end of the roller assembly is shown, it will be understood that the opposing end is similarly constructed. Thus, the ends can act independent of each other controlled and supported by the linkage structure which is described. The rollers are driven in rotation by gearing through a suitable power input motor, not shown, and suitable material feed mechanism for raw stock to be crushed is provided.

I claim as my invention:

1. A two roll crusher, comprising in combination:

first and second parallel rollers supported for rotation toward each other to crush stock passing into a crushing nip formed between the rollers;

gearings for the rollers flexibly connected to each other for absorption of reaction movements;

first and second end plates connected coaxially with the rolls at the roll ends and having ends projecting radially of the roll axes in opposite directions;

first levers pivotally connected at each end of the first plate;

second levers pivotally connected at each end of the second plate;

said first and second levers pivotally connected to each other between the plates at a junction point;

and a rigid link means pivotally connected to each junction point so as to extend between points and limit movement of said plates to parallel movement for absorbing reaction movement caused by the rolls.

2. A two roll crusher constructed in accordance with claim 1:

wherein the levers form an angle therebetween and function as toggle levers.

3. A two roll crusher constructed in accordance with claim 1:

including a rigid extension from one of said end plates pivotally connecting to a supporting frame.

4. A two roll crusher constructed in accordance with claim 1:

including means connected to one of said plates and a frame to fix the position of the plates for movement parallel to said rigid link means.

5. A two roll crusher constructed in accordance with claim 1:

wherein said rigid link means extends parallel to said plates.

6. A two roll crusher constructed in accordance with claim 1:

wherein said rigid link means extends intermediate the rolls at the location of the nip.

7. A two roll crusher, comprising in combination:

first and second parallel rollers supported for rotation toward each other to crush stock passing into a crushing nip formed between the rollers;

gearings for the rollers flexibly connected to each other for absorption of reaction moments;

first and second flat end plates coaxially connected at the roll ends and symmetrically extending radially in opposing directions from each axis of each roll;

first straight levers each pivotally connected at one end to the first plate;

second straight levers each pivotally connected at one end to the second plate;

said first and second levers being of equal length and being pivotally connected to each other at a junction point between the plates;

a rigid straight link pivotally connected to each junction point with the first levers being parallel to each other and the second levers parallel to each other wherein the movement of said plates is limited to being parallel for absorbing reaction moments caused by the rolls;

a rigid bell crank arm projecting mid-point from the second plate;

and a pivotal arm connected between the bell crank and a rigid frame for fixing the position of the second plate.

8. A two roll crusher, comprising in combination:

first and second parallel rollers supported for rotation toward each other to crush stock passing into a crushing nip formed between the rollers;

gearings for the rollers flexibly connected to each other for absorption of reaction movement;

first and second flat end plates coaxially connected with each of the roll ends respectively and having ends projecting radially in opposite direction;

first straight levers pivotally connected at one end to each end of the first plate;

second levers providing rocker arms pivotally connected at a mid-point to each end of the second plate;

one end of the rocker arm pivotally connected to the end of the first link;

a rigid link pivotally connected to the opposite end of the rocker arms so as to extend between the rocker arms and limit movement of the plates to parallel movement;

and a pivotal arm connected between one end of the second plate and a frame for positioning the second plate.

9. A two roll crusher, comprising in combination:

first and second parallel rollers supported for rotation toward each other to crush stock passing into a crushing nip formed between the rollers;

gearings for the rollers flexibly connected to each other for absorption of reaction movements;

first and second end plates connected coaxially with the rolls at the roll ends and having ends projecting radially of the roll axes in opposite directions;

first levers pivotally connected at each end of the first plate;

second levers pivotally connected at each end of the second plate;

said first levers each pivotally connected to a second lever between the plates at a junction point;

and a rigid link extending substantially parallel to said end plates and pivotally connected to said second levers at a location offset from the connection of the second levers to said plate whereby said second levers will remain substantially parallel with pivotal movement thereof.

10. A two roll crusher constructed in accordance with claim 9:

including a pivotal arm pivotally connected between one end of said second plate and a rigid frame.

11. A two roller crusher constructed in accordance with claim 9:

wherein each of said second levers has an extension projecting laterally away from its point of connection to the second plate and said rigid link is pivotally connected to said extension

12. A two roller crusher constructed in accordance with claim 9:

when said second levers are constructed as rocker arms with an intermediate point connected to the second plate and one end connected to the first levers and the other end connected to said rigid link.

13. A two roller crusher constructed in accordance with claim 9:

wherein the location of the pivotal connection between the rigid link and the second levers is coincident with the location of the connection point of said first levers to said second levers.

* * * * *